US006860312B2

(12) United States Patent
Judkins

(10) Patent No.: US 6,860,312 B2
(45) Date of Patent: Mar. 1, 2005

(54) ROLL-UP SHADE WITH CORD CAPTURE

(76) Inventor: Ren Judkins, 46 Newgate Rd., Pittsburgh, PA (US) 15202

( * ) Notice: Subject to any disclaimer, the term of this patent is extended or adjusted under 35 U.S.C. 154(b) by 14 days.

(21) Appl. No.: 10/256,314

(22) Filed: Sep. 27, 2002

(65) Prior Publication Data

US 2004/0060670 A1 Apr. 1, 2004

(51) Int. Cl.[7] ..... A47G 5/02
(52) U.S. Cl. ..... 160/243; 160/133
(58) Field of Search ..... 160/133, 238, 160/243

(56) References Cited

U.S. PATENT DOCUMENTS

| | | | | | |
|---|---|---|---|---|---|
| 97,726 | A | * | 12/1869 | Tay | 160/243 |
| 201,553 | A | * | 3/1878 | Paling | 160/243 |
| 204,858 | A | * | 6/1878 | Stowe | 160/243 |
| 618,906 | A | * | 2/1899 | Reimer | 160/243 |
| 862,644 | A | * | 8/1907 | Kepler | 160/243 |
| 892,264 | A | * | 6/1908 | Jordan | 160/243 |
| 1,028,293 | A | * | 6/1912 | Sidman | 160/243 |
| 2,582,276 | A | * | 1/1952 | Powers | 160/243 |
| 4,727,921 | A | | 3/1988 | Vecchiarelli | |
| 5,069,264 | A | | 12/1991 | Klawiter | |
| 5,195,594 | A | * | 3/1993 | Allen et al. | 169/48 |
| 5,533,559 | A | | 7/1996 | Judkins | |
| 5,785,105 | A | * | 7/1998 | Crider et al. | 160/243 |
| 5,966,854 | A | * | 10/1999 | Walsh et al. | 40/514 |
| 2003/0051829 | A1 | * | 3/2003 | Sears et al. | 160/243 |

OTHER PUBLICATIONS

WINDOWARE, Smith & Noble 1966, Catalog of Window Treatments, pp. 20, 22.

* cited by examiner

*Primary Examiner*—Bruce A. Lev
(74) *Attorney, Agent, or Firm*—Buchanan Ingersoll, P.C.

(57) ABSTRACT

A roll-up shade with cord capture has a headrail, a bottomrail, a panel of window covering material between the headrail and the bottomrail and a plurality of looped cords extending from the headrail down one side of the panel of window covering material, around the bottom edge, up an opposite side of the panel of window covering material and into the headrail such that movement of the looped cords into the headrail will cause the panel of window covering material to roll up and movement of the cords out of the headrail will cause the window covering material to unroll. A rod extends across one side of the panel of window covering material and captures the looped cords between the rod and the surface of the window covering material or in apertures through the rod or in apertures formed by clips or eyelets attached to the rod.

47 Claims, 8 Drawing Sheets

FIG. 15
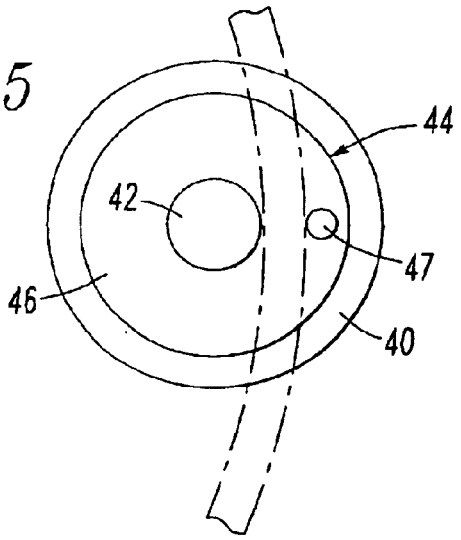
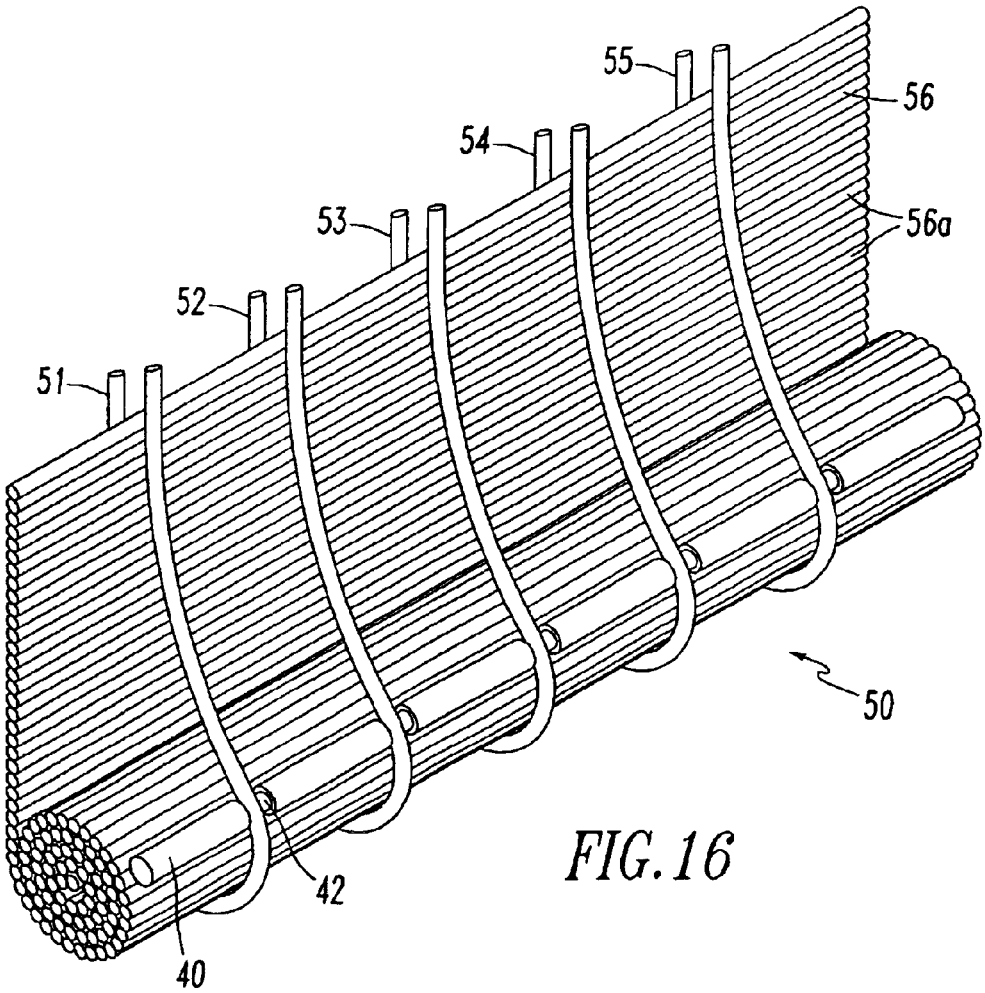
FIG. 16

FIG.20
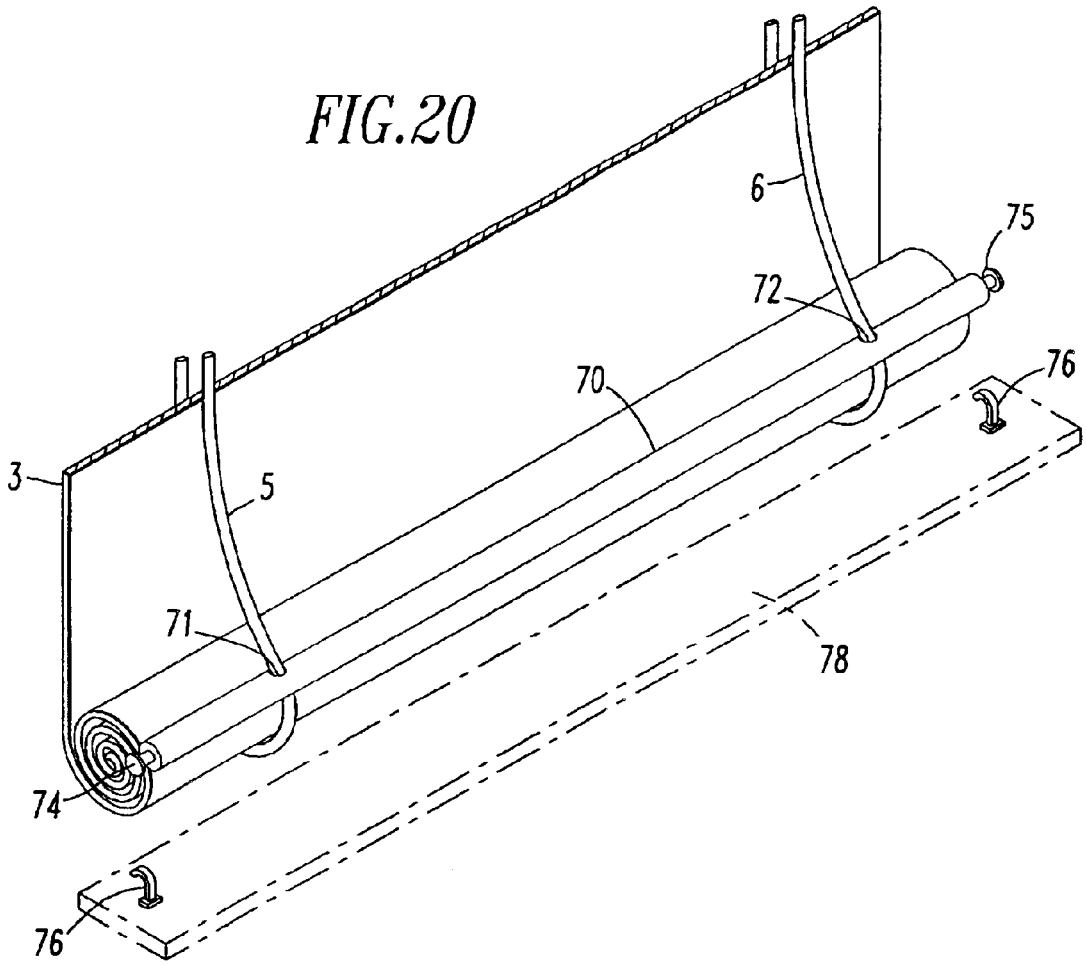
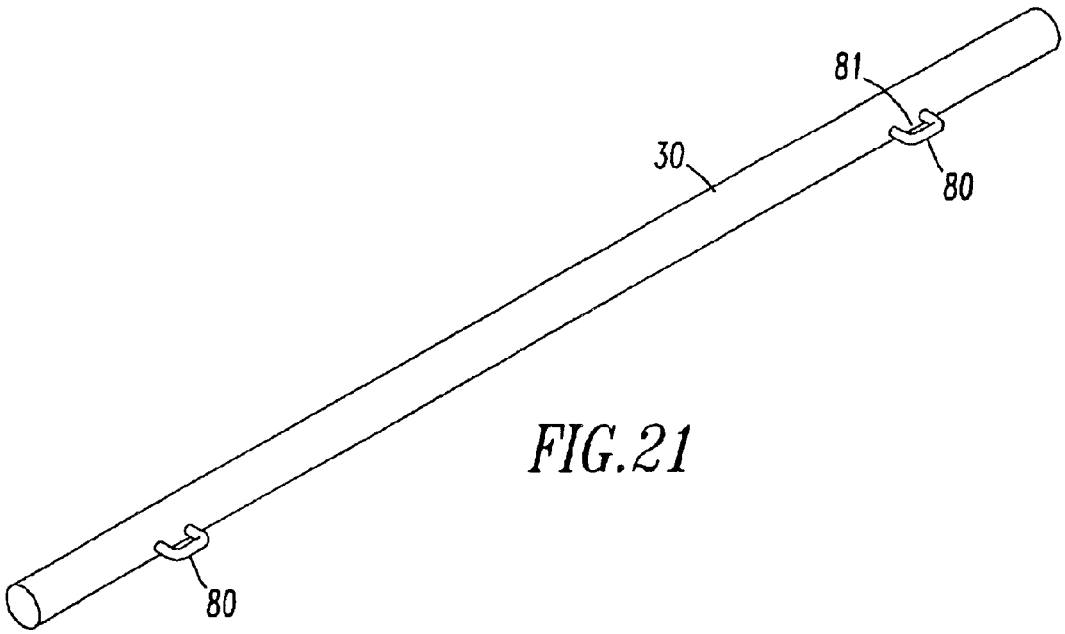
FIG.21

ROLL-UP SHADE WITH CORD CAPTURE

FIELD OF INVENTION

The invention relates to window coverings of the type in which a panel of window covering material extends from a headrail and is raised and lowered by rolling and unrolling the material from the bottom edge of the material.

BACKGROUND OF THE INVENTION

One popular type of window covering is the roll-up shade. This shade has a panel of window covering material attached at its top edge to a headrail. Two or more looped cords extend from the headrail down one side of the panel of window covering material, around the bottom edge of the panel and up an opposite side of the panel of window covering material into the headrail. The cords may then pass through a cord lock in the headrail or wind around a cord collector within the headrail. Movement of the cords into the headrail will cause the panel of window covering material to roll-up and movement of the cords out of the headrail will cause the window covering material to unroll. The looped cords are spaced apart from one another. The number of looped cords will depend upon the width of the window covering material but every roll-up shade has at least two looped cords.

In recent years there has been much concern in the window covering industry about child safety. There have been instances involving pleated shades and venetian type blinds in which a child's head and neck have become entangled in a cord loop that is used to raise and lower, or open and close, the blind and the child was strangled. Consequently, the United States Consumer Product Safety Commission has held hearings and proposed regulations that require looped cords in window covering products to be eliminated or require a device that breaks the loop in the event of entanglement or require a device that envelops or restrains the cord in such a way that a child could not become entangled in the loop. Roll-up shades have looped cords in which the panel of window covering material is captured. Although there has never been a reported incident of a child becoming entangled in a roll-up shade, some have observed that the loops in a roll-up shade pose the same danger as cord loops that are used to raise and lower, or open and close, other types of blinds.

Window coverings are purchased for decorative as well as functional reasons. Consequently, any child safety device that is added to a window covering product must not detract from the appearance of the product. If it does, a consumer will either not purchase the product or will remove the child safety device from the product.

Consequently, there is a need for a cord capture system for roll-up shades that will prevent a child from becoming entangled in the looped cords that carry the window covering material. Additionally, the cord capture system should be aesthetically pleasing and not detract from the overall appearance of the product.

SUMMARY OF THE INVENTION

I provide a roll-up shade having a cord capture system in which a rod extends across the width of the window covering material and prevents the looped cords from being pulled away from the shade. Consequently, a child cannot pull a loop away from the window covering material and get his head entangled in the cord loop.

I prefer to provide apertures in the rod through which at least the outermost looped cords pass. In one embodiment an eyelet is attached to each end of the rod and each of the outermost looped cords passes through one of the eyelets. Any additional looped cords pass between the rod and the surface of the window covering material over which the rod extends. I prefer that the eyelets rotate relative to the rod allowing the rod to roll along the window covering material as it is rolled and unrolled.

In another preferred embodiment clips or retainers are attached to the rod at spaced apart intervals. One of the looped cords passes through an aperture formed by the rod and the retainer or an aperture through the retainer. A similar structure can be created without a retainer by providing apertures through the rod. A separate aperture can be provided for each cord. Alternatively, an aperture can be provided for only the outermost cords. All other cords are then routed between the rod and the window covering material. Rollers or spacers may be used in combination with the clips. In this embodiment the rod preferably extends nearly the full width of the window covering material.

In yet another embodiment the roll-up shade has a bottomrail and a pair of brackets attached between ends of the rod and the bottomrail. The looped cords are captured between the rod and the surface of the panel of window covering material. I prefer that the rod be connected to the bracket in a manner that allows the rod to rotate and ride on the roll of window covering material. I further prefer that the looped cords pass through apertures in the rod or provided by retainers attached to the rod. Then the rod can roll against or ride on the window covering material as the material is rolled and unrolled.

The rod also provides a means to hold down the shade and particularly the cord loops to prevent a child or the wind from moving the shade out of its normal plane of operation. On small shades a catch might be provided at each end of the rod. That rod may extend to the bottom corners of the shade panel, end outside of the outermost loops, or have a length intermediate those two sizes. Wider shades might have catches dispersed along the width of the window and possibly the rod at points convenient for mounting such catches such as opposite mullions or the posts in a railing. It is preferred that these catches be hooks that require the operator to push the rod down against the elasticity of the cords to engage them.

I further prefer to provide a roll-up shade in which the panel of window covering material is a woven wood containing a plurality of wood sticks or plastic straws and the rod is a material and color that matches the wood sticks or straws. Consequently, the rod blends with the window covering material and is not very noticeable.

Other objects and advantages of the present invention will become apparent from a description of the present preferred embodiments shown in the drawings.

BRIEF DESCRIPTION OF THE FIGURES

FIG. 15 is a sectional view taken along the line XV—XV in FIG. 14.

FIG. 16 is a perspective view of a third present preferred embodiment of my roll-up shade.

FIG. 20 is a perspective view of a fifth present preferred embodiment of my roll-up shade.

FIG. 21 is a perspective view of a rod that can be used in place of the rod used in the embodiment of FIG. 20.

DESCRIPTION OF THE PREFERRED EMBODIMENTS

Figure 1:
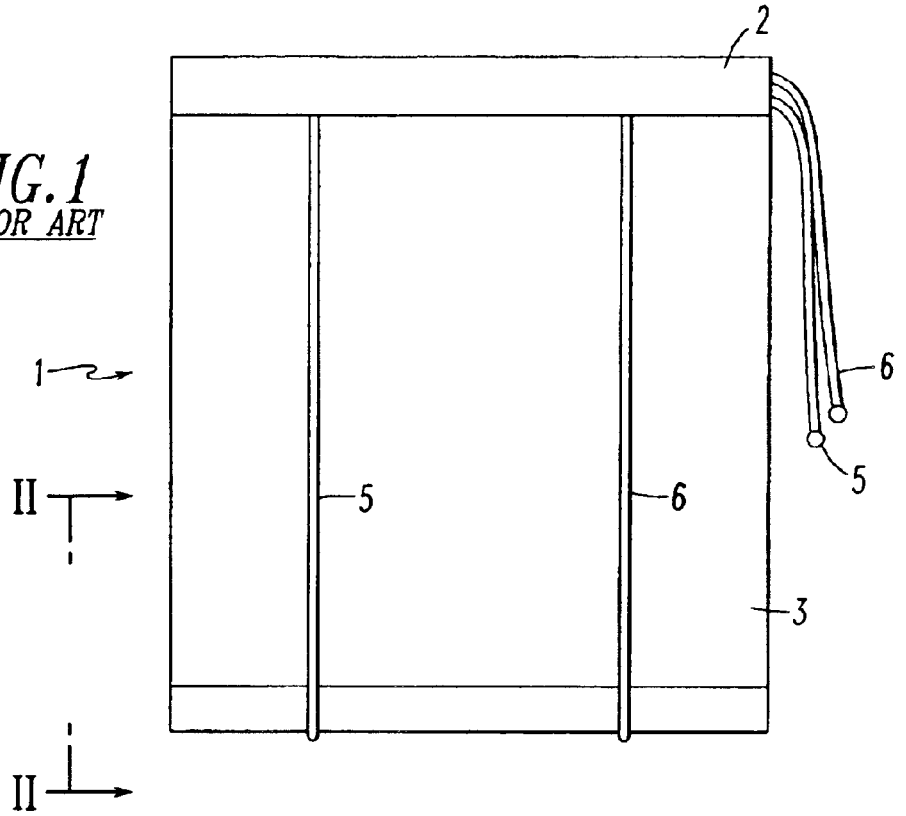
FIG. 1 PRIOR ART
FIG. 1 is a front view of a roll-up shade of the type known in the art.
Figure 2:
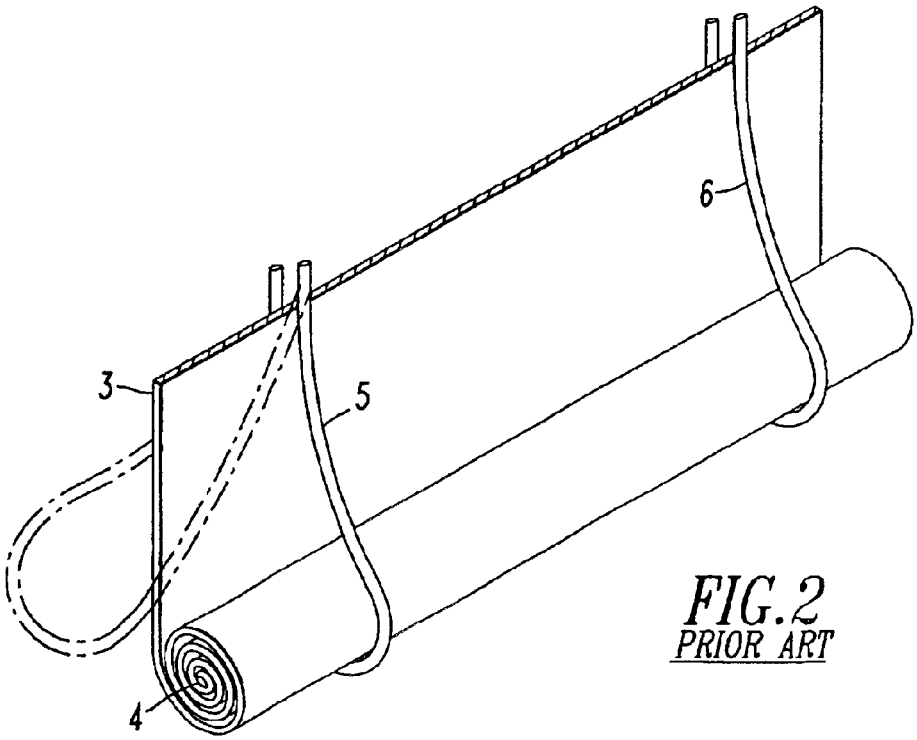
FIG. 2 PRIOR ART
FIG. 2 is a perspective view of a portion of the roll-up shade shown in FIG. 1 viewed along the line II—II in FIG. 1.

A typical roll-up shade is shown in FIGS. 1 and 2. That roll-up shade 1 has a headrail 2 from which window covering material 3 extends. The bottom edge of the window covering material 3 typically has a bottomrail or rod 4 about which the window covering material can be rolled and unrolled. Two or more looped cords 5 and 6 are provided to raise and lower the shade. Each looped cord has one end attached to the headrail. The cord runs down the back surface of the window covering material around the bottom edge and loops back into the headrail. Typically the cords will pass through a cord lock and exit the headrail as shown in FIG. 1. However, many roll-up shades do not have a cord lock. An operator can raise or lower the shade by pulling or releasing the lift cords 5 and 6. Pulling the lift cords causes the window covering material to roll up about the bottomrail 4. Alternatively, the looped cords could be collected on a cord collector within the headrail rather than pass through a cord lock or pulleys. The window covering material may be fabric, woven wood, woven grasses or plastic straws. Some have expressed concern that the outermost looped cords could easily be pulled away from the window covering material as shown in dotted line in FIG. 2. A child conceivably could do this forming a free loop in which his head and neck could become entangled. I, therefore, provide a cord capture system for roll-up shades which will prevent the looped cords from being pulled away from the shade as shown in dotted line in FIG. 2.

Figure 3:
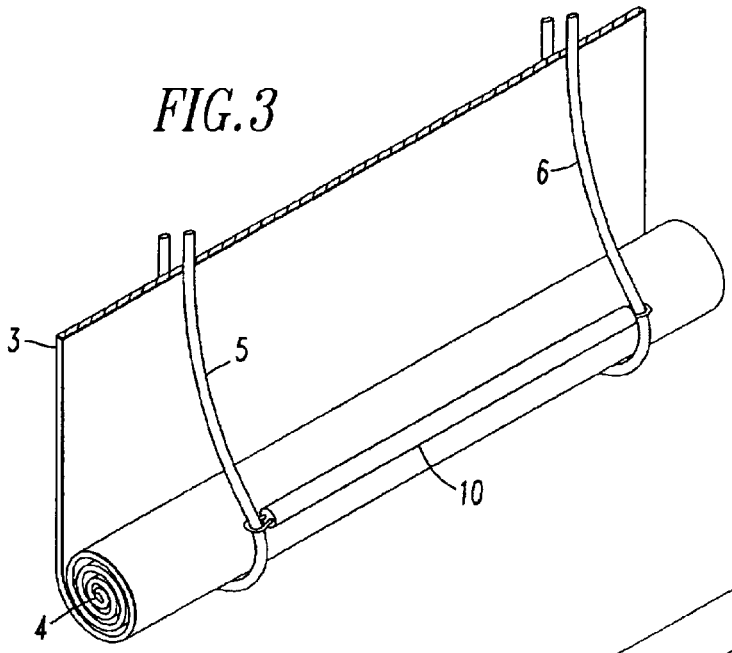
FIG. 3 is perspective view similar to FIG. 2 showing a first present preferred embodiment of my roll-up shade with cord capture.
Figure 4:
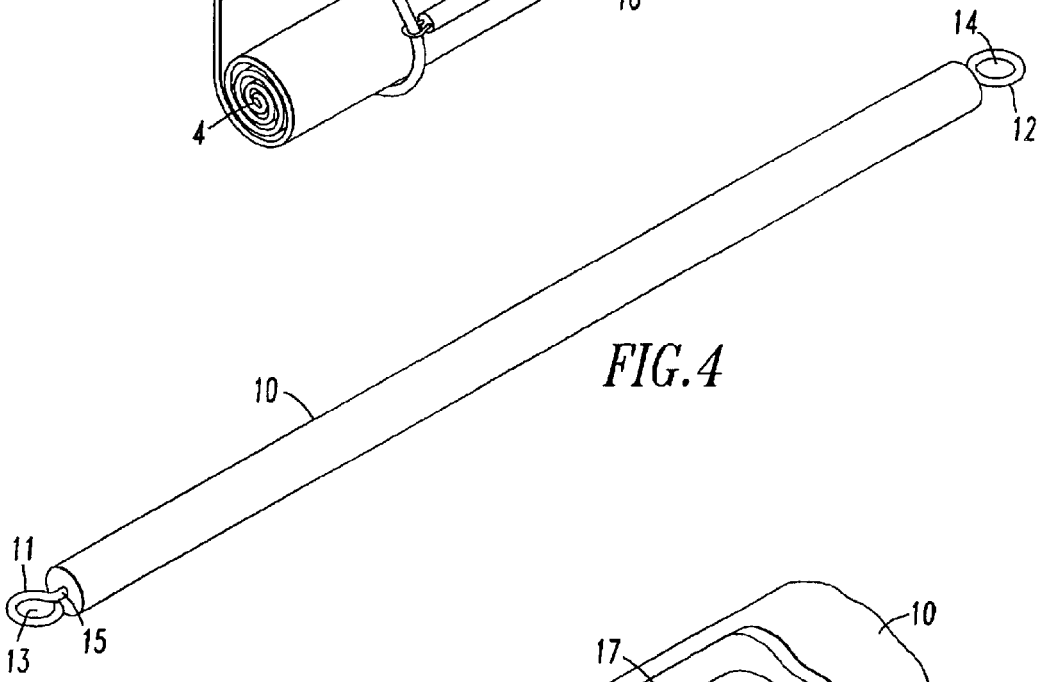
FIG. 4 is a perspective view of the rod used in the embodiment shown in FIG. 3.
Figure 5:
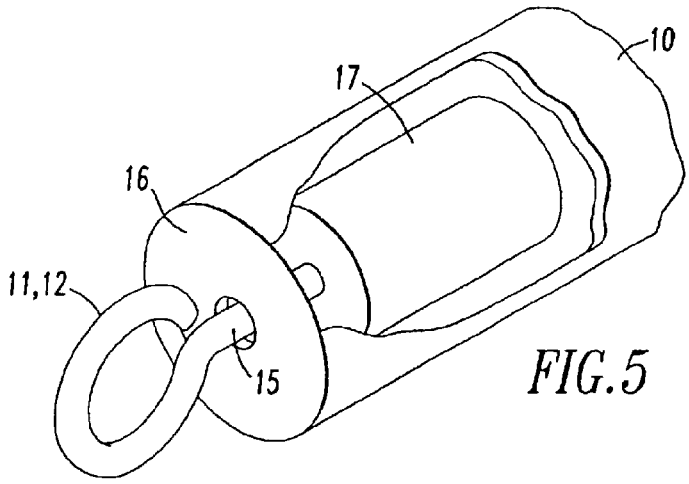
FIG. 5 is a perspective view of an end of a rod of the type shown in FIG. 4 partially cut away to show one way to connect the eyelet to the rod.
Figure 6:
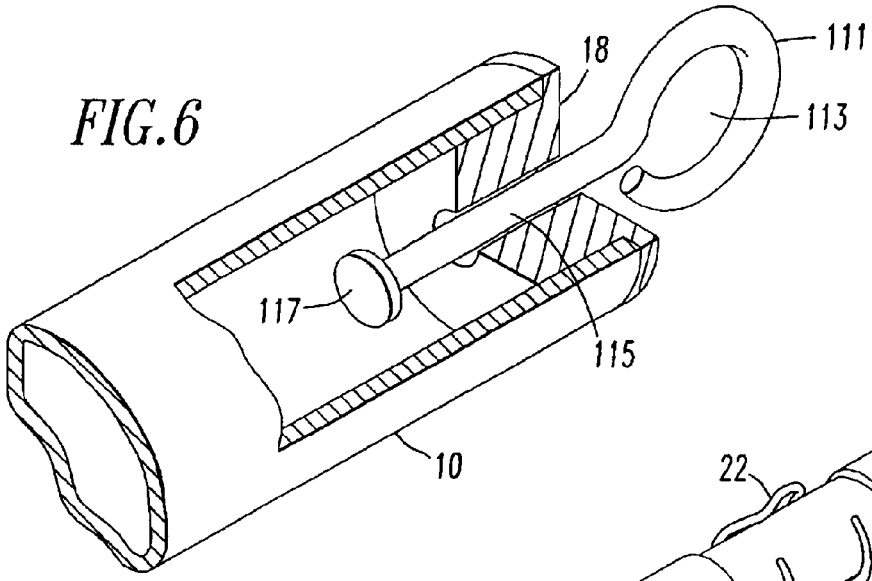
FIG. 6 is a perspective view similar to FIG. 5 showing another way to connect the eyelet to the rod.

In a first preferred embodiment of my roll-up shade shown in FIG. 3, I provide a rod 10 having eyelets 11 and 12 at opposite ends. The outermost cords 5 and 6 of the blind pass through the hole or eye 13, 14 in the eyelets. I prefer that the stem 15 of each eyelet be inserted into the end of the rod 10 in such a manner that the eyelets 11 and 12 can rotate relative to the rod 10. For smoothest operation the stems should be on a common axis through the rod and the rod will rotate around that axis. Consequently, when the window covering material is rolled and unrolled to raise and lower the shade, the rod 10 will roll along the surface of the window covering material and minimize wear. The stem 15 of the eyelet 11, 12 could extend through a hole in an end cap 16 into a free spinning plug 17 as shown in FIG. 5. Yet, another possibility is to make the rod 10 of polyvinylchloride tubing as shown in FIG. 6 with a PVC plug 18 glued into the end of the pipe. The eyelet 111 is a polypropylene eyebolt having an eye portion 113 with an attached stem 111 that extends through the plug 18. Of course, other plastics, wood or metal could be used for these parts. The end of the stem 115 within the pipe has an enlarged head or attached nut 117 to prevent the eyelet from being pulled from the rod. During assembly the stem 115 is inserted into the plug 18. Then the nut is attached or the head is enlarged. Finally the plug 18 with the eyelet 111 is inserted into the end of the rod 10. The stem 115 is longer than the thickness of the plug 18 to enable the eyelet to move into and out of the rod 10. This compensates for a change in the spacing between the cords 5 and 6 which could occur during installation. This same effect could be achieved by providing an elongated or elliptical eye in an eyelet that may or may not move in and out relative to the rod. Although the eyelet can be any suitable metal or plastic, I prefer to use brass. If the eyelet is of the type shown in FIG. 5 in which the eye is formed by bending a metal wire around a mandrel, the small opening adjacent the end of the wire should face the window covering material when the eyelet is installed. That position makes it more difficult for someone to pull a lift cord from the eye through the opening. In the embodiment shown in FIG. 3 only two looped cords are provided on the shade. A wider shade or heavier shade may require additional looped cords. Those cords would be positioned between cords 5 and 6 and run between rod 10 and the surface of the window covering material 3 against which rod 10 is positioned. In this way, these additional cords would be captured by the rod 10.

Figure 7:
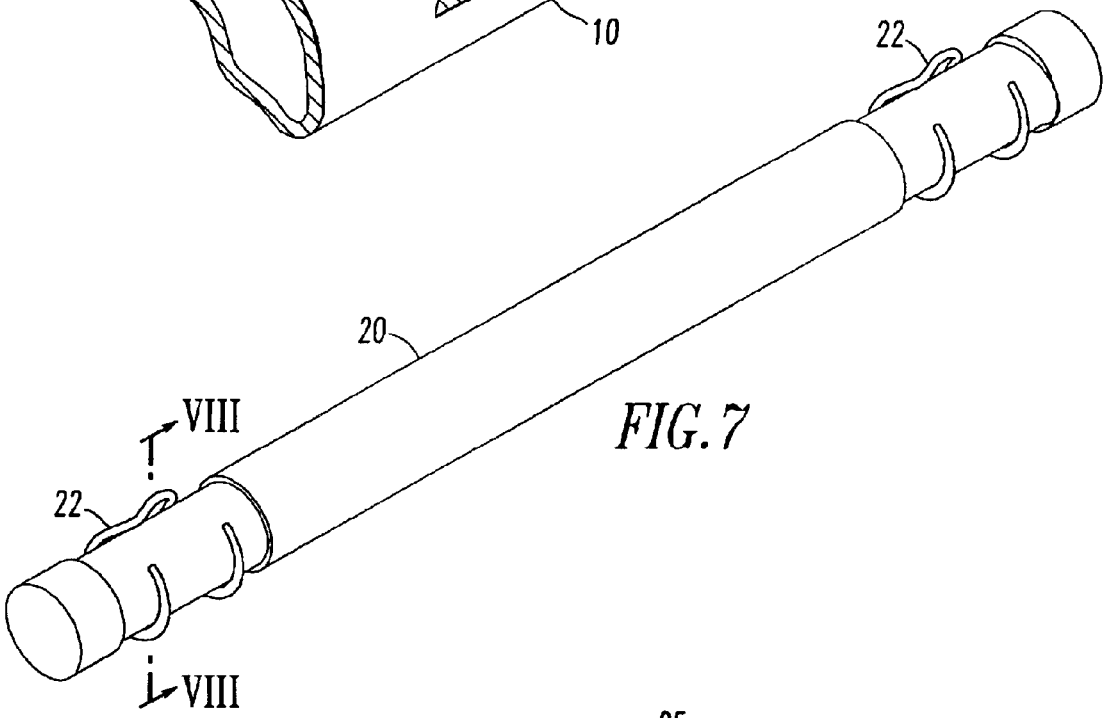
FIG. 7 is a perspective view similar to FIG. 4 of the rod used in a second present preferred embodiment of my roll-up shade.
Figure 8:
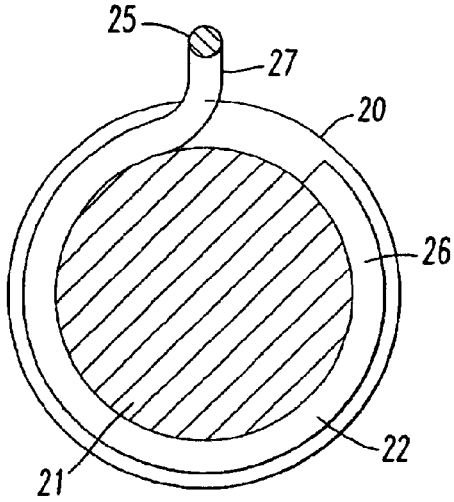
FIG. 8 is a sectional view taken along the line VIII—VIII in FIG. 7.
Figure 9:
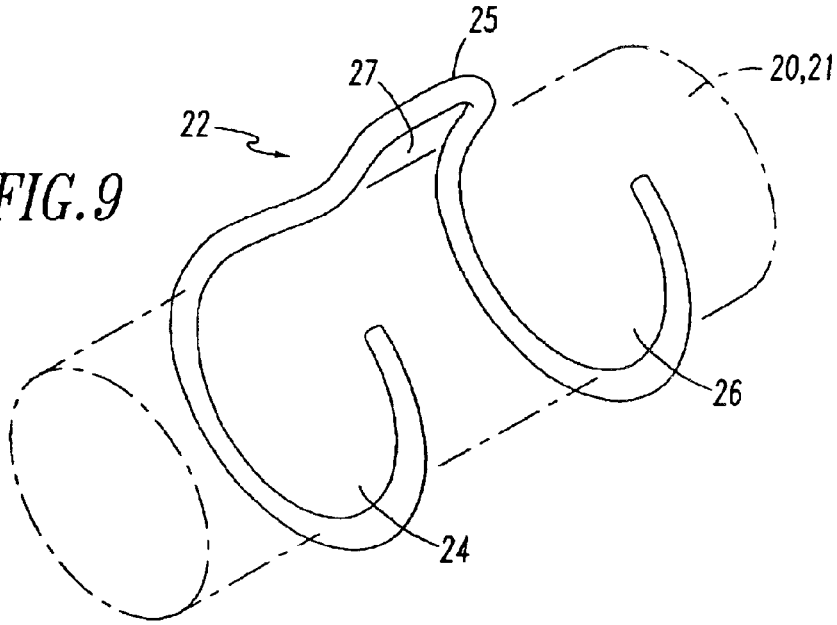
FIG. 9 is a perspective view of the clip used on the rod shown in FIGS. 7 and 8.

A second embodiment of my roll-up shade with cord capture system is similar to that shown in FIG. 3, but uses a rod 20 having at least two retainers or clips 22 attached to the rod 20 as shown in FIGS. 7, 8 and 9. As can be seen most clearly in FIGS. 8 and 9, the clip 22 is formed of a wire bent to have two aligned rings 24 and 26 through which a portion 21 of the rod 20 may pass. A loop portion 25 is provided between the rings 24 and 26. The loop 25 and the rod portion 21 together define an aperture 27 through which one of the looped cords can pass. Clips can be provided for the only outermost looped cords or for every looped cord. The portion 21 of the rod 20 where each clip 22 is attached has a smaller diameter than other portions of the rod as shown in FIG. 8. In fact the diameter of portion 21 plus twice the diameter of the wire that forms the clip is less than the major diameter of the rod. Thus, clip 22 does not touch the window covering material 3. Furthermore, clip 22 is attached so that the rod portion 21 can turn within the clip allowing the rod 20 to roll on the window covering material as the blind is raised and lowered. The lift cord passing through the loop 25 will keep the loop oriented away from the window covering material.

Figure 10:
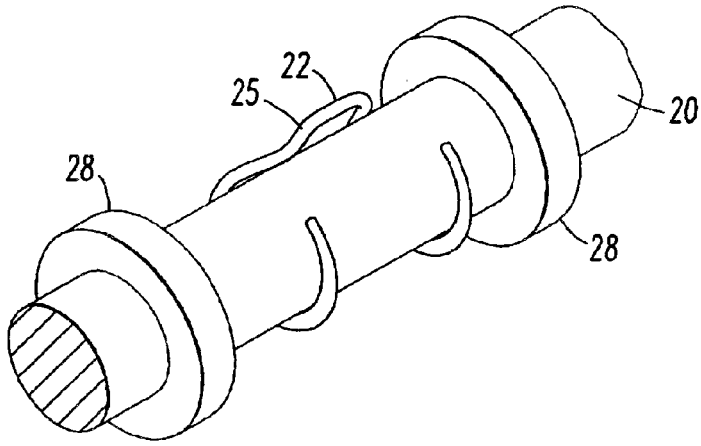
FIG. 10 is a perspective view of a rod similar to the rod shown in FIG. 7, but of constant diameter with a clip and rollers.

As can be seen in FIG. 10, one could use a clip 22 like that shown in FIG. 1 on a rod 20 of constant diameter by providing rollers 28 on the rod. In this embodiment the rollers 28 act as spacers limiting the side to side travel of the clips while the clips can rotate freely about the rod 20. When the window covering is raised and lowered the rollers 28 will press against the window covering such that movement of the window covering material causes the rollers 28 and attached rod 20 to rotate. The height of the loop portion 25 may extend a distance from the rod 20 that is greater than the distance between the rod and the edge of the rollers 28. The lift cord keeps the loop oriented away from the window covering material. Spacing the rollers 28 apart from one another at a distance greater than the width of the clip, which is the distance between the aligned rings 24 and 26 of the clip 22, permits the clip to travel along the rod and compensate for differences in spacing of the lift cords 5 and 6 from one another.

Figure 11:
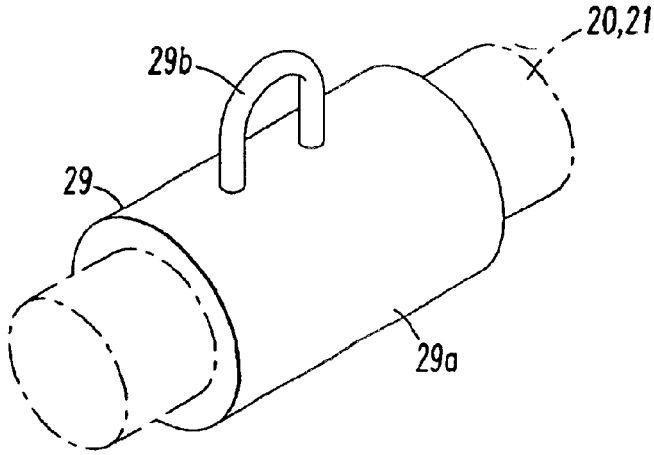
FIG. 11 is a perspective view of a clip that can be used in place of the clip shown in FIGS. 7 through 10.

A different type of clip 29 could be used in place of the wire clip 22 shown in FIGS. 7 through 10. That clip 29, shown in FIG. 11, has a tubular portion 29*a* of a selected width which fits over the rod 20 or portion of the rod 21 and a loop 29*b* through which a lift cord passes. Preferably, clip 29 is a molded plastic part.

Figure 12:
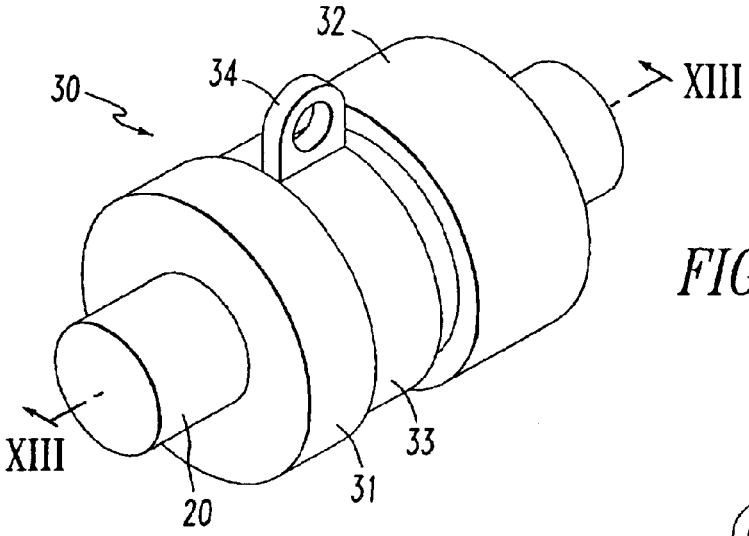
FIG. 12 is a perspective view of another clip on a mandrel attached to a rod of constant diameter.
Figure 13:
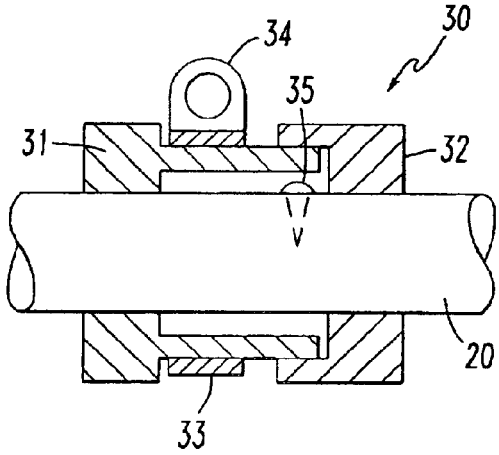
FIG. 13 is a sectional view taken along the line XIII—XIII in FIG. 12.

A similar clip and roller arrangement that could be used is shown in FIGS. 12 and 13. This clip 30 has a male portion 31 which fits over a rod 20 and receives ring portion 33. A female portion 32 is fitted over the rod and fits over the male portion 31 to capture the ring. Preferably, the male portion 31 and female portion 32 are configured to snap fit together. The outer surfaces of the male and female portions 31 and 32 ride on the window covering material. These portions rotate around rod 20 and within the ring 33. A stop 35 such as a tack is attached to the rod 20 to prevent the clip from traveling too far along the rod. The loop 34 may or may not extend beyond the outer surfaces of the male and female portions 31, 32. The lift cord passing through the loop 34 keeps the loop oriented away from the window covering material.

Figure 14:
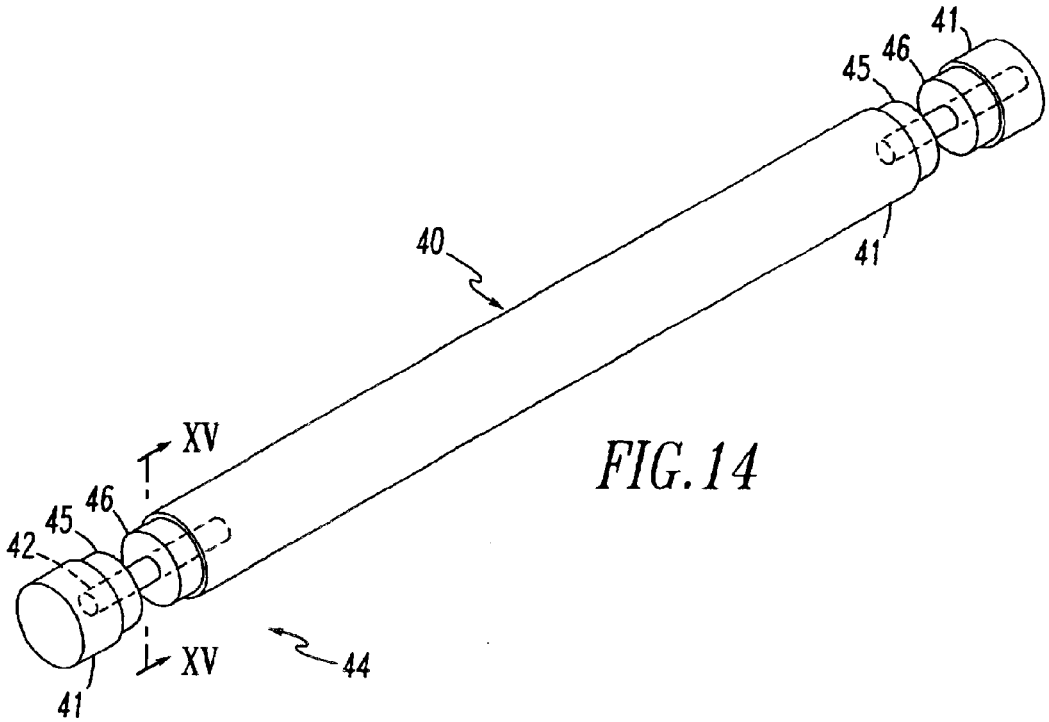
FIG. 14 is a perspective view of a rod used in a third present preferred embodiment of my roll-up shade.

A third present preferred embodiment of my roll-up shade 50 is shown in FIGS. 14, 15 and 16. In that embodiment a rod 40 has a series of segments 41 that are fastened together by axles 42. A cord holder or clip 44 is carried on each axle 42 such that the axles and rod segment can rotate relative to the cord holder 44. The cord holder has two halves 45 and 46 connected together by a pin 47. If desired, more than one pin could be used. As can be seen most clearly in FIG. 15, halves 45 and 46 together with the pin 47 and axle 42 define an aperture through which a lift cord shown in dotted line may pass. When the window covering material is rolled and unrolled, the rod segments 41 will roll on the window covering material. The cord carrier 44 could have a diameter larger than the diameter of the rod segments. However, I prefer that the rod segments 41 be larger in diameter as shown in FIGS. 14 and 15. Although each cord holder or clip 44 is shown as being carried on a separate axle 42, one could provide a single axle running nearly the full length of the rod 40. In the embodiment shown in FIGS. 14, 15, 16, one clip 44 is provided for each of the looped lift cords 51, 52, 53, 54 and 55. However, clips could be eliminated for any and all but the outermost cords 51 and 55.

The window covering material 56 is a woven wood in which a series of sticks 56*a* are placed side to side and held in place by longitudinal threads (not shown) that would be generally parallel to the cords 51 through 55. I prefer that rod extend slightly less than the full width of the window covering material as shown in FIG. 16. In a preferred embodiment rod 40 has a length that is one inch less than the width of the shade. Furthermore, I prefer that the rod be of the same material or at least of the same color as the sticks 56*a*. When so constructed, the rod 40 is not readily noticeable and could easily be mistaken as part of the window covering material by a casual observer. If the window covering material is a woven wood the diameter of the rod should be larger than the diameter of the sticks so that the rod will roll better.

Figure 17:
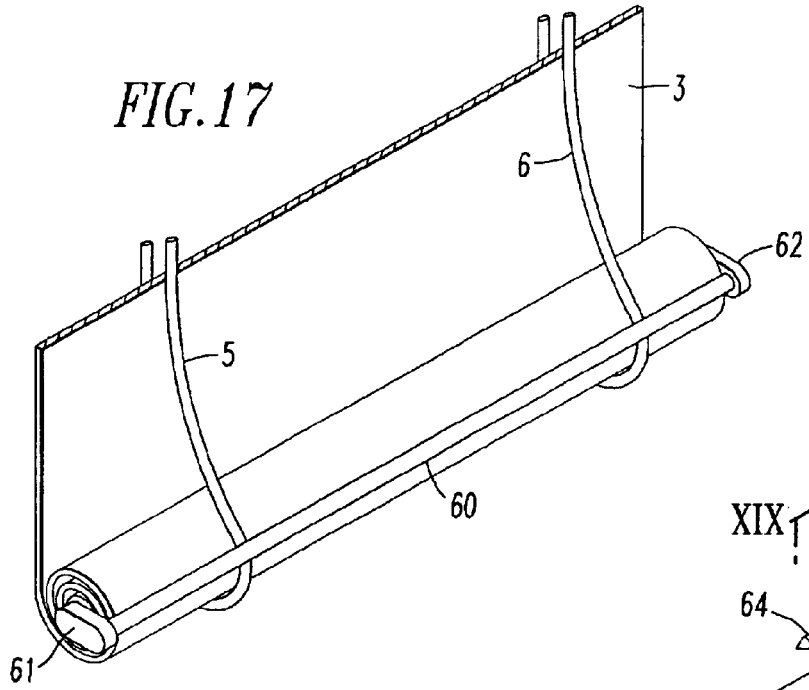
FIG. 17 is a perspective view of a fourth present preferred embodiment of my roll-up shade.
Figure 18:
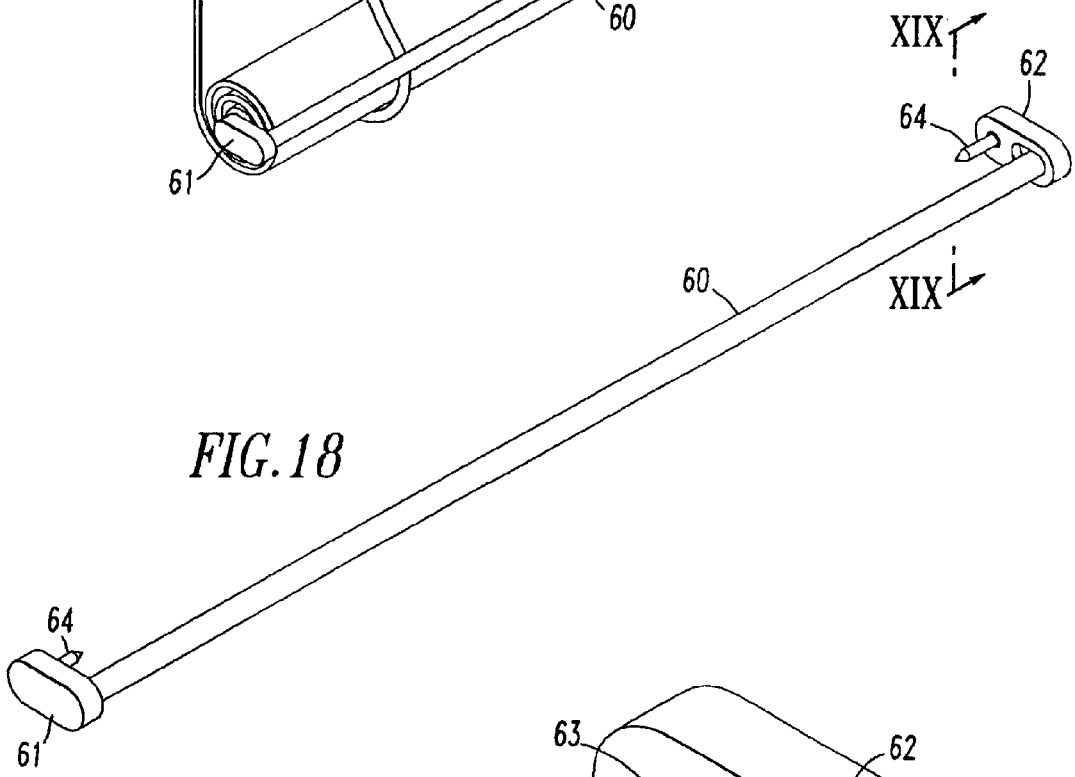
FIG. 18 is a perspective view of the rod and brackets used in the fourth present preferred embodiment that is shown in FIG. 17.
Figure 19:
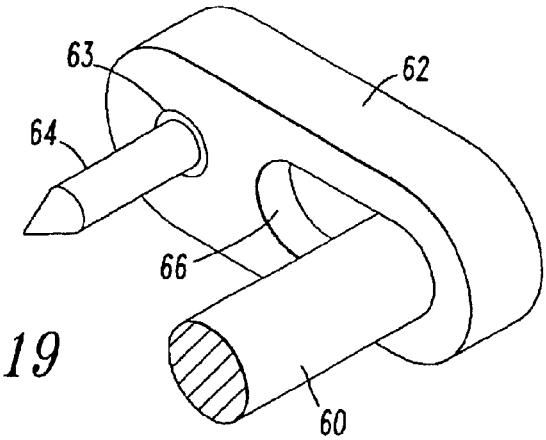
FIG. 19 is a sectional view taken along the line XIV—XIV in FIG. 18.

In a fourth preferred embodiment shown in FIGS. 17, 18 and 19, the rod 60 extends the full width of the window covering material 3. The rod 60 is attached to either end of the bottomrail (not shown) by brackets 61 and 62. A pin 64 passes through each bracket and into one end of the bottomrail. The hole 63 in each bracket 61 and 62 through which the pin 64 passes is sized so that the brackets can rotate about the pins. This allows the rod 62 to travel from the backside of the window covering material to the front and back again as the shade is raised and lowered. The rod 60 is carried in a slot 66 in each bracket to allow the rod to move away from the pin 64 as the roll of window covering material increases. Of course, the brackets 61, 62 must be of sufficient length so that the distance between the pin 64 and the rod 60 when the rod is furthest away from the pin 64 is greater than the radius of the roll of window covering material when the material has been fully rolled up. If desired apertures could be created by drilling the rod or by clips attached to rod 60 and the looped cords can be routed through those apertures. In that event rod 60 could resemble the rods shown in FIGS. 7, 10, 12, 14, 20 or 21. Indeed, I prefer to use such rods on larger shades because the brackets will not support the rod along its full width allowing the rod to bow. The cords passing through the apertures will keep the rod 60 resting on the surface of the window covering material.

The rod used in each of the embodiments disclosed here should be made of a material and color that make the rod less noticeable to the casual observer. In the embodiment of FIG. 16 the rod was selected to be of the same material and color as the sticks in the woven wood window covering material. The rod in the other embodiments could be a wooden rod. Alternatively, the rod could be plastic which is clear or of the same color as the window covering material. If the rod is used with fabric window covering material, the rod could be painted to have the same color as the fabric or could be covered with the same fabric as is used for the window covering material.

While I prefer that the apertures on the rods be formed as in the embodiments shown in the FIGS. 3 through 16, it is also possible that rings could be fastened to the rods and the lift cords pass through the rings.

In the embodiment shown in FIG. 20 a rod 70 has apertures 71 and 72 formed by drilling holes through the rod at the locations of the looped cords. One looped cord 5 or 6 passes through each aperture. A pin 74 or 75 is provided at each end of rod 70. A pair of hooks 76 is attached to the window sill 78 shown in dotted lines or another convenient location. When the blind is fully lowered the pins 74 and 75 are secured within the hooks 76 to hold down the blind. I prefer that the hooks can be sized and positioned to require the operator to push the rod 70 down against the looped cords to engage the pins in the hooks 76. This is possible because the cords have some elasticity. Other types of catches such as magnets or straps could be used in place of the hooks and pins. Furthermore, the hooks could be at other locations on the window frame. Moreover, the hooks could be sized and positioned to engage the bar directly avoiding the need for any pins.

Yet, another way to provide apertures for the looped cords is shown in FIG. 21. In this embodiment staples 80 are driven into the rod 30 at selected locations along the rod that correspond to the positions of the looped cords. One looped cord passes through the aperture 81 formed by each staple 80 and the rod 30. Staples could be provided for all of the looped cords or just the outermost cords. This embodiment is less complicated and less expensive than the embodiments of FIGS. 3 through 16. However, in this embodiment, as well as in the embodiment of FIG. 20, the rod cannot rotate as the shade is raised and lowered. Consequently, the rod will ride on and rub against the window covering material as the shade is raised and lowered causing some wear of the window covering material.

As pointed out in the description of the preferred embodiments the rod could be any desired length and diameter. The rods can be made from a variety of different materials. The shape of the rod in each of the illustrated embodiments is shown as being cylindrical with a circular cross section. However, a different cross section such as a square, triangle or other polygon shape could be used.

Although I have shown and described certain present preferred embodiments of my rollup shade with cord capture system, it should be understood that the invention is not limited thereto, but may be various embodied within the scope of the following claims.

What is claimed is:

1. A roll-up shade with cord capture comprising:

a headrail;

a panel of window covering material having a width, a top edge attached to the headrail and a bottom edge;

a rail attached to the bottom edge of the panel of window covering material such that the panel can be wound around the rail;

a plurality of looped cords each cord having a first end attached to the headrail, and each cord extending from the headrail down one side of the panel of window covering material, around the bottom edge and up an opposite side of the panel of window covering material and into the headrail such that movement of the cords into the headrail will cause the panel of window covering material to roll up and movement of the cords out of the headrail will cause the window covering material to unroll, the looped cords spaced apart from one another; and a rod parallel to the rail and extending across one side of the panel of window covering material, the rod having at least two apertures such that one of the looped cords passes through each aperture.

2. The roll-up shade of claim 1 wherein the rod has an eyelet attached to each end, each eyelet having a loop and a stem extending from the loop such that each eyelet contains one of the at least two apertures and the stem is attached to the rod.

3. The roll-up shade of claim 2 wherein the eyelets are connected to the rod in a manner that permits the rod to rotate relative to each eyelet about an axis through the stems of the eyelets.

4. The roll-up shade of claim 2 also comprising a clip having an aperture attached to the rod and wherein there are at least three looped cords, one cord passing through the aperture in the clip, the second cord passing through one of the eyelets and the third cord passing through the other eyelet.

5. The roll-up shade of claim 2 wherein there are at least three looped cords, one cord passing through one of the eyelets, the second cord passing through the other eyelet, and all other cords passing between the rod and the side of the panel of window covering material across which the rod extends.

6. The roll-up shade of claim 2 wherein each eyelet has an elliptical aperture.

7. The roll-up shade of claim 1 wherein the rod is comprised of an elongated body having a plurality of clips each clip forming one of the at least two apertures.

8. The roll-up shade of claim 7 also comprised of a pair of rollers for each clip, the rollers being attached to the elongated body such that one roller of each pair of rollers is at either side of the clip.

9. The roll-up shade of claim 8 wherein the clips have a width and the rollers in each pair of rollers are spaced apart at a distance greater than that width.

10. The roll-up shade of claim 7 wherein the clips are one of wire clips and plastic clips.

11. The roll-up shade of claim 7 wherein each aperture is bounded by a portion of the clip and a portion of the rod.

12. The roll-up shade of claim 1 wherein the panel of window covering material has a width and the rod extends less than completely across the width of the panel of window covering material.

13. The roll-up shade of claim 1 wherein the panel of window covering material is a woven wood containing a plurality of sticks or straws and the rod is a material and color that matches the sticks or straws.

14. The roll-up shade of claim 1 wherein the panel of window covering material is a fabric and also comprising a rod covering fabric that covers the rod, the rod covering fabric selected from the group consisting of the fabric of the window covering material and fabrics that match the fabric of the window covering material.

15. The roll-up shade of claim 1 wherein the rod is comprised of:

a plurality of rod segments;

a plurality of axles, there being one less axle than rod segment, each axle connected between two rod segments the axles being on a common axis; and a cord carrier on each axle, the cord carrier having a first portion and a second portion carried on the axle such that the axle can rotate relative to the first and second portions and a pin attached between the first portion and the second portion in a manner to maintain the first portion in a spaced apart relationship from the second portion and such that the pin, the axle, the first portion and the second portion define one of the at least two apertures.

16. The roll-up shade of claim 15 wherein the plurality of axles is formed by a single elongated body.

17. The roll-up shade of claim 1 also comprising at least two staples driven into the rod such that each staple and the rod from one of the at least two apertures.

18. The roll-up shade of claim 1 also comprising at least two catches sized and configured for attachment to a window frame and for removable attachment to the rod.

19. The roll-up shade of claim 18 where the catches are hooks.

20. A roll-up shade with cord capture comprising:

a headrail;

a bottomrail;

a panel of window covering material having a top edge attached to the headrail and a bottom edge attached to the bottomrail such that the panel can be wound about the bottomrail;

a plurality of looped cords each cord having a first end attached to the headrail, and each cord extending from the headrail down one side of the panel of window covering material, around the bottomrail and up an opposite side of the panel of window covering material and into the headrail such that movement of the cords into the headrail will cause the panel of window covering material to roll up and movement of the cords out of the headrail will cause the window covering material to unroll, the looped cords spaced apart from one another;

a rod parallel to the bottomrail and extending across one side of the panel of window covering material; and a pair of brackets connecting the rod to the bottomrail such that the looped cords pass between the rod and the side of the panel of window covering material across which the rod extends.

21. The roll-up shade of claim 20 wherein the brackets are rotatably attached to the bottomrail.

22. The roll-up shade of claim 20 wherein the panel of window covering material is a woven wood containing a plurality of sticks and the rod is a material and color that matches the sticks.

23. The roll-up shade of claim 20 also comprising a plurality of clips attached to the rod such that the at least two apertures are formed by the clips.

24. The roll-up shade of claim 23 also comprised of a pair of rollers for each clip, the rollers being attached to the elongated body such that one roller of each pair of rollers is at either side of the clip.

25. The roll-up shade of claim 24 wherein the clips have a width and the rollers in each pair of rollers are spaced apart at a distance greater than that width.

26. The roll-up shade of claim 23 wherein the clips are one of wire clips and plastic clips.

27. The roll-up shade of claim 23 wherein each aperture is bounded by a portion of a clip and a portion of the rod.

28. The roll-up shade of claim 20 wherein the panel of window covering material is a woven wood containing a plurality of sticks or straws and the rod is a material and color that matches the sticks or straws.

29. The roll-up shade of claim 20 wherein the panel of window covering material is a fabric and also comprising a rod covering fabric that covers the rod, the rod covering fabric selected from the group consisting of the fabric of the window covering material and fabrics that match the fabric of the window covering material.

30. The roll-up shade of claim 20 wherein the rod is comprised of:

a plurality of rod segments;

a plurality of axles, there being one less axle than rod segment, each axle connected between two rod segments the axles being on a common axis; and a cord carrier on each axle, the cord carrier having a first portion and a second portion carried on the axle such that the axle can rotate relative to the first and second portions and a pin attached between the first portion and the second portion in a manner to maintain the first portion in a spaced apart relationship from the second portion and such that the pin, the axle, the first portion and the second portion define one of the at least two apertures.

31. The roll-up shade of claim 30 wherein the plurality of axles is formed by a single elongated body.

32. The roll-up shade of claim 20 wherein each bracket has an elongated slot and one end of the rod is in the elongated slot.

33. The roll-up shade of claim 20 also comprising at least two catches sized and configured for attachment to a window frame and for removable attachment to the rod or the brackets.

34. The roll-up shade of claim 33 where the catches are hooks.

35. A roll-up shade with cord capture comprising:

a headrail;

a bottomrail;

a panel of window covering material having a top edge attached to the headrail and a bottom edge attached to the bottomrail such that the panel can be wound about the bottomrail;

a plurality of looped cords each cord having a first end attached to the headrail and each cord extending from the headrail down one side of the panel of window covering material, around the bottomrail and up an opposite side of the panel of window covering material and into the headrail such that movement of the cords into the headrail will cause the panel of window covering material to roll up and movement of the cords out of the headrail will cause the window covering material to unroll, the looped cords spaced apart from one another;

a rod parallel to the bottomrail and extending across one side of the panel of window covering material, the rod having at least two apertures such that one of the looped cords passes through each aperture; and a pair of brackets connecting the rod to the bottomrail.

36. The roll-up shade of claim 35 wherein the rod is comprised of an elongated body having a plurality of clips each clip forming one of the at least two apertures.

37. The roll-up shade of claim 36 also comprised of a pair of rollers for each clip, the rollers being attached to the elongated body such that one roller of each pair of rollers is at either side of the clip.

38. The roll-up shade of claim 37 wherein the clips have a width and the rollers in each pair of rollers are spaced apart at a distance greater than that width.

39. The roll-up shade of claim 36 wherein the clips one of wire clips and plastic clips.

40. The roll-up shade of claim 36 wherein each aperture is bounded by a portion of the clip and a portion of the rod.

41. The roll-up shade of claim 35 wherein the panel of window covering material is a woven wood containing a plurality of sticks or straws and the rod is a material and color that matches the sticks or straws.

42. The roll-up shade of claim 35 wherein the panel of window covering material is a fabric and also comprising a rod covering fabric that covers the rod, the rod covering fabric selected from the group consisting of the fabric of the window covering material and fabrics that match the fabric of the window covering material.

43. The roll-up shade of claim 35 wherein the rod is comprised of:

a plurality of rod segments;

a plurality of axles, there being one less axle than rod segment, each axle connected between two rod segments the axles being on a common axis; and a cord carrier on each axle, the cord carrier having a first portion and a second portion carried on the axle such that the axle can rotate relative to the first and second portions and a pin attached between the first portion and the second portion in a manner to maintain the first portion in a spaced apart relationship from the second portion and such that the pin, the axle, the first portion and the second portion define one of the at least two apertures.

44. The roll-up shade of claim 43 wherein the plurality of axles is formed by a single elongated body.

45. The roll-up shade of claim 35 also comprising at least two staples driven into the rod such that each staple and the rod from one of the at least two apertures.

46. The roll-up shade of claim 35 also comprising at least two catches sized and configured for attachment to a widow frame and removably attached to the rod.

47. The roll-up shade of claim 46 where the catches are hooks.

* * * * *

UNITED STATES PATENT AND TRADEMARK OFFICE

CERTIFICATE OF CORRECTION

PATENT NO. : 6,860,312 B2
DATED : March 1, 2005
INVENTOR(S) : Ren Judkins

It is certified that error appears in the above-identified patent and that said Letters Patent is hereby corrected as shown below:

Column 10,
Line 62, change “widow” to -- window --.

Signed and Sealed this

Fourteenth Day of June, 2005

JON W. DUDAS
*Director of the United States Patent and Trademark Office*